US008319806B2

(12) United States Patent
Mikami

(10) Patent No.: US 8,319,806 B2
(45) Date of Patent: Nov. 27, 2012

(54) MOVEMENT DETECTION APPARATUS AND RECORDING APPARATUS

(75) Inventor: Ruriko Mikami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 247 days.

(21) Appl. No.: 12/911,543

(22) Filed: Oct. 25, 2010

(65) Prior Publication Data

US 2011/0102533 A1 May 5, 2011

(30) Foreign Application Priority Data

Oct. 30, 2009 (JP) ..... 2009-250825

(51) Int. Cl.
*B41J 2/00* (2006.01)

(52) U.S. Cl. ..... 347/110
(58) Field of Classification Search ..... None
See application file for complete search history.

(56) References Cited

FOREIGN PATENT DOCUMENTS

JP 2007-217176 A 8/2007

*Primary Examiner* — Stephen Meier
*Assistant Examiner* — Tracey McMillion
(74) *Attorney, Agent, or Firm* — Canon U.S.A., Inc. IP Division

(57) ABSTRACT

An apparatus performs a pattern matching operation based on a template pattern size in the moving direction set according to information about the moving state of an object between acquisitions of first and second data, such as an encoder configured to acquire information about the moving state of the object.

20 Claims, 17 Drawing Sheets

$$Tw = W - m' - x$$

DOWNSTREAM
M
W
1000A

Tw1
m1
1000B

Tw2
m2
1000C

Tw3
m3
1000D

WHEN m1 ≧ m2 ≧ m3Tw1 ≦ Tw2 ≦ Tw3 IS SATISFIED

FIG. 11

| CONVEYANCE AMOUNT | CONVEYANCE SPEED | TEMPLATE PATTERN SIZE |
|---|---|---|
| M1 | S1 | SIZE T1 |
| M2 | S2 | SIZE T2 |

WHEN M1>M2 AND S1>S2, T1<T2 IS SATISFIED $$Tw \leqq W-2m$$

MOVEMENT DETECTION APPARATUS AND RECORDING APPARATUS

BACKGROUND OF THE INVENTION

1. Field of the Invention

The present invention relates to a technique for detecting the movement of an object through image processing, and to a technical field of a recording apparatus.

2. Description of the Related Art

When performing printing on a medium such as a print sheet while it is being conveyed, a low conveyance precision causes an uneven density of a halftone image or a magnification error, resulting in degraded quality of a printed image. Therefore, although recording apparatuses employ high-precision components and carry an accurate conveyance mechanism, there is a strong demand for higher print quality and higher conveyance precision. At the same time, there is also a strong demand for cost reduction and the achievement of both higher precision and lower cost is demanded.

To meet this demand, an attempt is made to detect the movement of a medium with high precision to achieve stable conveyance through feedback control. A method used in this attempt, also referred to as direct sensing, images the surface of the medium to detect through image processing the movement of the medium being conveyed.

Japanese Patent Application Laid-Open No. 2007-217176 discusses a method of direct sensing. The method in Japanese Patent Application Laid-Open No. 2007-217176 images the surface of a moving medium a plurality of times in a time sequential manner by using an image sensor, and compares acquired images through a pattern matching operation to detect the amount of movement of the medium. Hereinafter, a method for directly detecting the surface of an object to detect its moving state is referred to as direct sensing, and a detector employing this method is referred to as a direct sensor.

To reliably perform determination in the pattern matching operation based on direct sensing, it is important that a template pattern to be set has an appropriate size and position. For example, FIG. 17A illustrates a case where a template pattern 1702 to be set for first image data 1700A primarily acquired has a too large size in the medium conveyance direction. When the entire template pattern 1702 does not fit into second image data 1700B acquired following the first image data 1700A, determination cannot be reliably performed. FIG. 17B illustrates a case where a template pattern 1703 to be set for first image data 1701A has a too small size. In this case, it is highly possible that, in addition to a true matching pattern, the second image data 1700B contains noise pattern similar to the true matching pattern, and the noise pattern is selected.

SUMMARY OF THE INVENTION

According to an aspect of the present invention, an apparatus includes: a conveyance mechanism configured to move an object in a predetermined direction; a sensor configured to capture an image of a surface of the object to acquire first and second data; a processing unit configured to extract a template pattern from the first data, and seek an area having a correlation with the template pattern among areas in the second data to obtain a moving state of the object; and an acquisition unit configured to acquire information about the moving state of the object between acquisitions of the first and second data, wherein the processing unit sets a template pattern size in the predetermined direction according to the acquired information.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 11 is a table illustrating an association between the conveyance amount/conveyance speed and the template pattern size.

DESCRIPTION OF THE EMBODIMENTS

Various exemplary embodiments, features, and aspects of the invention will be described in detail below with reference to the drawings. However, the components described in the following exemplary embodiments are illustrative and are not meant to limit the scope of the present invention.

A first exemplary embodiment will be described below. The scope of the present invention widely ranges from a printer to further a field of movement detection which requires high-precision detection of the movement of an object. For example, the present invention is applicable to printers, scanners, and other devices used in technical, industrial, and commodity distribution fields for conveying an object and performing inspection, reading, processing, marking, and other various processing on the target object. Further, the present invention is applicable to diverse types of printers including ink jet printers, electrophotographic printers, thermal printers, and dot impact printers. In the present specification, a medium means a sheet-like or plate-shaped medium such as paper, a plastic sheet, a film, glass, ceramics, resin, and so on. Further, in the present specification, the upstream and downstream sides mean the sides upstream and downstream in the sheet conveyance direction at the time of image recording on a sheet.

An embodiment of an ink jet printer which is an exemplary recording apparatus will be described below. The printer according to the present exemplary embodiment is a serial printer which alternately performs main scanning and sub scanning to form a two-dimensional image. In main scanning, the printer reciprocally moves a print head. In sub scanning, the printer conveys a medium in a stepwise feeding manner by a predetermined amount. The present invention is applicable not only to a serial printer but also to a line printer having a full line print head covering the print width, which moves a medium relative to the fixed print head to form a two-dimensional image.

Figure 1:
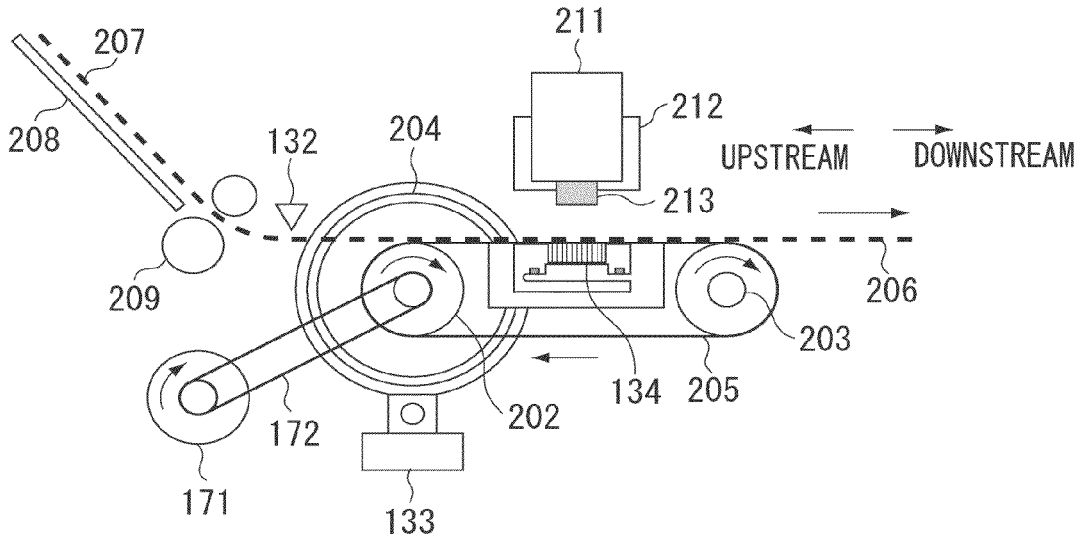
FIG. 1 is a sectional view of a printer according to an exemplary embodiment of the present invention.

FIG. 1 is a sectional view illustrating a configuration of an essential part of a printer. The printer includes a conveyance mechanism for moving the medium in the sub scanning direction (first direction or a predetermined direction) by a belt conveyance system, and a recording unit configured to perform recording on a moving medium by using a print head. The printer further includes a rotary encoder 133 configured to indirectly detect the moving state of an object, and a direct sensor 134 configured to directly detect the moving state of the object.

The conveyance mechanism includes a first roller 202 and a second roller 203 which are rotating members, and a wide conveyance belt 205 entrained between the first and second rollers by a predetermined tension. A medium 206 adhering to the surface of the conveyance belt 205 by electrostatic attraction or adhesion is conveyed by the movement of the conveyance belt 205. The rotational force of the conveyance motor 171, a driving source for sub scanning, is transmitted to the first roller 202, a drive roller, via the drive belt 172 to rotate the first roller 202. The first roller 202 and the second roller 203 rotate in synchronization with each other via the conveyance belt 205. The conveyance mechanism further includes a feed roller pair 209 for separating one medium from media 207 loaded on a tray 208 and feeding it onto the conveyance belt 205, and a feed motor 161 (not illustrated in FIG. 1) for driving the feed roller pair 209. A paper end sensor 132 disposed on the downstream side of the feed motor 161 detects a leading edge or trailing edge of a medium to acquire a timing of medium conveyance.

The rotary encoder (rotational angle sensor) 133 is used to detect the rotating state of the first roller 202 to indirectly acquire the moving state of the conveyance belt 205. The rotary encoder 133 including a photograph interrupter optically reads slits circumferentially arranged at equal intervals on a code wheel 204, which is coaxially attached to the first roller 202 to generate a pulse signal.

The direct sensor 134 is disposed below the conveyance belt 205 (on the rear surface side of the medium 206, i.e., the side opposite to the side on which the medium 206 is loaded). The direct sensor 134 includes an image sensor for imaging an area containing markers on the surface of the conveyance belt 205. The direct sensor 134 directly detects the moving state of the conveyance belt 205 through image processing to be mentioned below. Since the medium 206 firmly sticks to the surface of the conveyance belt 205, a variation in the relative position by the slip between the surface of the conveyance belt 205 and the medium 206 is vanishingly small. It is assumed that the direct sensor 134 can directly detect the moving state of the medium 206. The function of direct sensor 134 is not limited to imaging the rear surface of the conveyance belt 205, but may be configured to image an area on the front surface of the conveyance belt 205 not covered by the medium 206. Further, the direct sensor 134 may image the surface of medium 206 instead of the surface of the conveyance belt 205.

The recording unit includes a carriage 212 reciprocally moving in the main scanning direction, a print head 213, and an ink tank 211, the latter two being mounted on the carriage 212. The carriage 212 reciprocally moves in the main scanning direction (second direction) by the driving force of a main scanning motor 151 (not illustrated in FIG. 1). Nozzles of the print head 213 discharge ink in synchronization with the movement of the carriage 212 to perform printing on the medium 206. The print head 213 and the ink tank 211 may be detachably attached to the carriage 212 either integrally as one or individually as separate components. The print head 213 discharges ink through the ink jet method. The ink discharge method may be based on a heater element, a piezoelectric element, an electrostatic element, an MEMS element, and so on.

Figure 2:
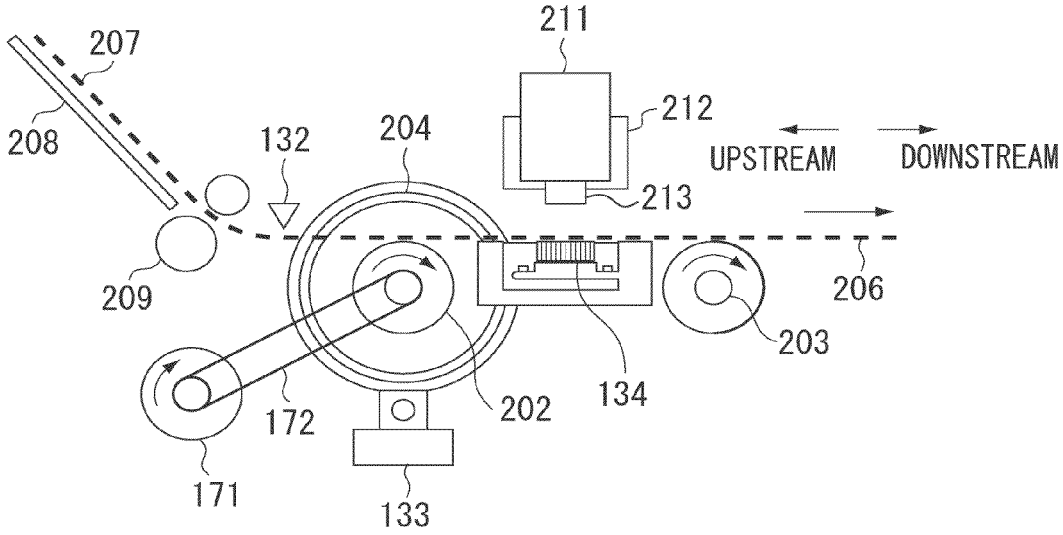
FIG. 2 is a sectional view of the printer according to a modification.

The conveyance mechanism is not limited to the belt conveyance system, but may include, as a modification, a mechanism for conveying a medium by using a conveyance roller instead of a conveyance belt. FIG. 2 illustrates a sectional view of the printer according to the modification. Referring to FIG. 2, members assigned the same reference numerals are identical to those of FIG. 1. The first roller 202 and the second roller 203 directly contact the medium 206 to move it. A synchronous belt (not illustrated) is applied between the first roller 202 and the second roller 203 so that the second roller 203 rotates in synchronization with the rotation of the first roller 202. In this modification, the direct sensor 134 images the rear surface of the medium 206 instead of the conveyance belt 205.

Figure 3:
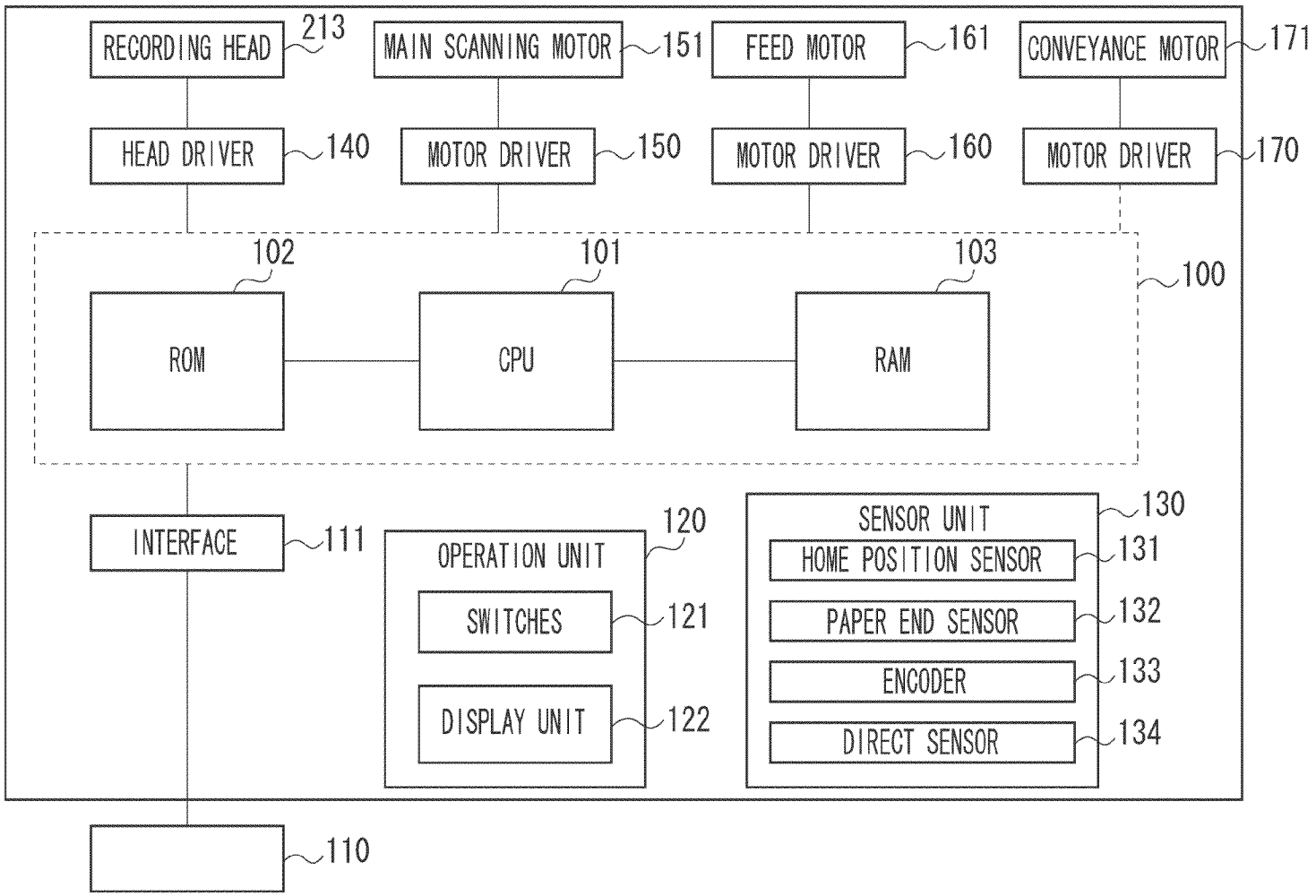
FIG. 3 is a system block diagram of the printer.

FIG. 3 is a system block diagram of the printer. A controller 100 includes a central processing unit (CPU) 101, a read-only memory (ROM) 102, and a random access memory (RAM) 103. The controller 100 serves also as a control unit and a processing unit to perform various control of the entire printer as well as image processing. An information processing apparatus 110 is an apparatus which supplies image data to be recorded on an medium, for example, a computer, a digital camera, a TV, and a mobile phone. The information processing apparatus 110 is connected with the controller 100 via an interface 111. An operation unit 120, which is a user interface for an operator, includes various input switches 121 including a power switch and a display unit 122. A sensor unit 130 includes various sensors for detecting various states of the printer. A home position sensor 131 detects the home position of the carriage 212 reciprocally moving. The sensor unit 130 includes the above-mentioned paper end sensor 132, the rotary encoder 133, and the direct sensor 134. Each of these sensors is connected to the controller 100. Based on commands of the controller 100, the print head and various motors for the printer are driven via respective drivers. A head driver 140 drives the print head 213 according to record data. A motor driver 150 drives the main scanning motor 151. A motor driver 160 drives the feed motor 161. A motor driver 170 drives the conveyance motor 171 in sub scanning.

Figure 4:
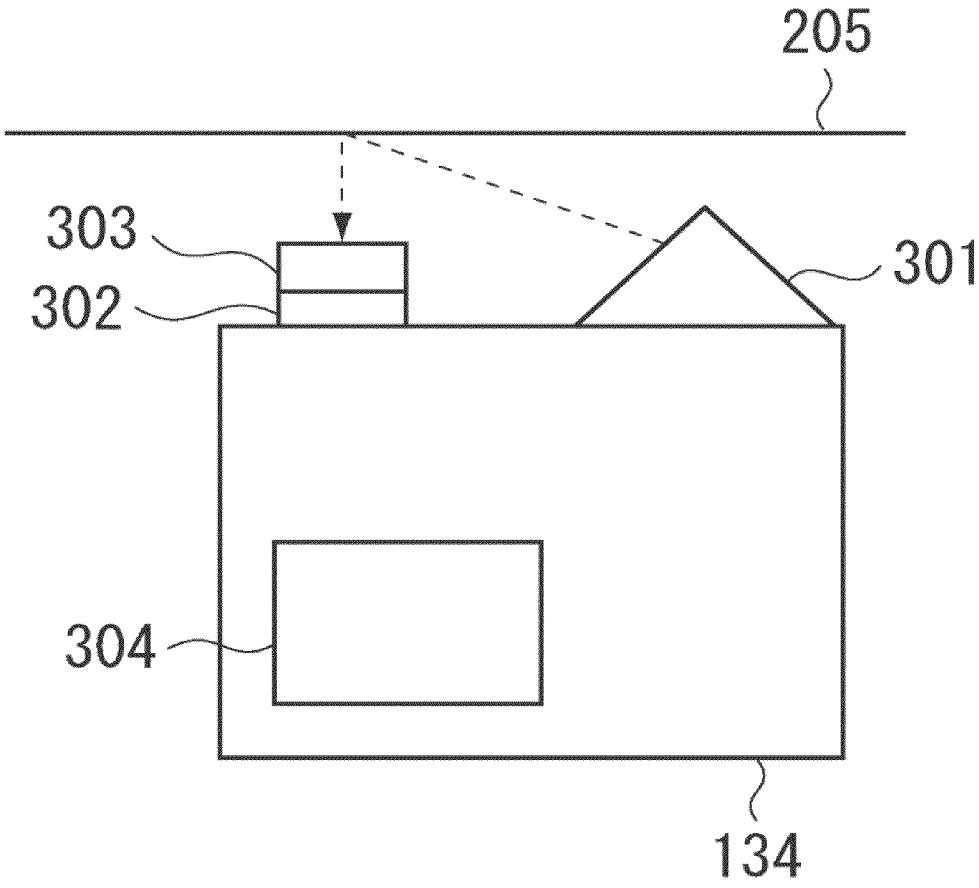
FIG. 4 illustrates a configuration of a direct sensor.

FIG. 4 illustrates a configuration of the direct sensor 134 for performing direct sensing. The direct sensor 134 is a single sensor unit which includes a light-emitting unit including a light source 301 such as a light-emitting diode (LED), an organic light-emitting diode (OLED), and a semiconductor laser; a light receiving unit including an image sensor 302 and a refractive-index distribution lens array 303; and a circuit unit 304 such as a drive circuit and an A/D converter circuit. The light source 301 illuminates a part of the rear surface of the conveyance belt 205 which is an imaging target. The image sensor 302 images via the refractive-index distribution lens array 303 a predetermined imaging area illuminated by the light source 301. The image sensor 302 is a two-dimensional area sensor such as a CCD sensor and a CMOS sensor, or a line sensor. An analog signal from the image sensor 302 is converted to digital form and captured as digital image data. The image sensor 302 is used to image the surface of an object (conveyance belt 205) and acquire a plurality of image data at different timings (these pieces of image data acquired in succession are referred to as first and second image data). As described below, by extracting a template pattern from the first image data, and seeking an area in the second image data having a large correlation with the extracted template pattern through image processing, the moving state of the object can be acquired. The image processing may be performed by the controller 100 or a processing unit included in the unit of the direct sensor 134.

Figure 5:
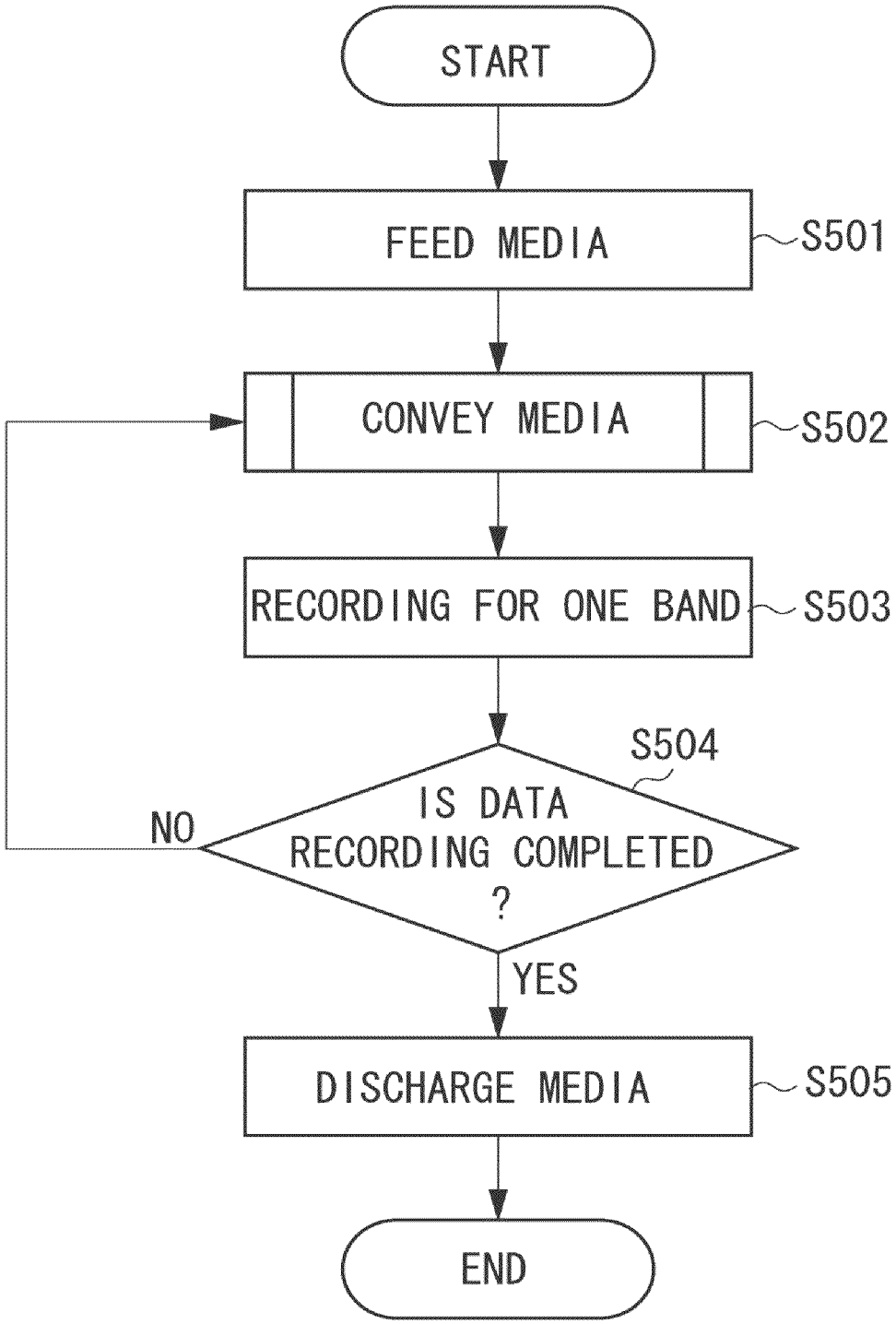
FIG. 5 is a flow chart illustrating processing of medium feeding, recording, and discharging.

FIG. 5 is a flow chart illustrating processing of medium feeding, recording, and discharging. This processing is performed based on commands of the controller 100. In step S501, the processing drives the feed motor 161 to rotate the feed roller pair 209 to separate one medium from the medium 207 on the tray 208 and feed it along the conveyance path. When the paper end sensor 132 detects the leading edge of the medium 206 being fed, the processing performs the medium positioning operation based on the detection timing to convey the medium to a predetermined recording start position.

In step S502, the processing conveys the medium in a stepwise feeding manner by a predetermined amount by using the conveyance belt 205. The predetermined amount equals the length in the sub scanning direction in recording of one band (one main scanning of the print head). For example, when performing multipass recording in a two-pass manner while causing each stepwise feeding by the length of a half of the nozzle array width in the sub scanning direction of the print head 213, the predetermined amount equals the length of a half of the nozzle array width.

In step S503, the processing performs recording for one band while moving the print head 213 in the main scanning direction by the carriage 212. In step S504, the processing determines whether recording of all record data is completed. When the processing determines that recording is not completed (NO in step S504), the processing returns to step S502 to repeat recording in a stepwise feeding manner (sub scanning) and one band (one main scanning). When the processing determines that recording is completed (YES in step S504), the processing proceeds to step S505. In step S505, the processing discharges the medium 206 from the recording unit, thus forming a two-dimensional image on the medium 206.

Processing of step feeding in step S502 will be described in detail below with reference to the flow chart illustrated in FIG. 6. In step S601, the processing images an area containing markers of the conveyance belt 205 by using the image sensor of the direct sensor 134. The acquired image data denotes the position of the conveyance belt 205 before starting movement and is stored in the RAM 103. In step S602, while monitoring the rotating state of the roller 202 by the rotary encoder 133, the processing drives the conveyance motor 171 to move the conveyance belt 205, in other words, starts conveyance control of the medium 206. The controller 100 performs servo control so that the medium 206 is conveyed by a target conveyance amount. The processing executes step S603 and subsequent steps in parallel with the medium conveyance control using the rotary encoder 133.

In step S603, the direct sensor 134 captures an image of the conveyance belt 205. Specifically, the image of the conveyance belt 205 is captured when the medium is assumed to have been conveyed by a predetermined amount based on the target amount of medium conveyance (hereinafter referred to as target conveyance amount) necessary to perform recording for one band, the image sensor width in the first direction, and the conveyance speed. In this example, a specific slit of the code wheel 204 to be detected by the rotary encoder 133 when the medium has been conveyed by the predetermined conveyance amount is designated, and the image of the conveyance belt 205 is captured when the rotary encoder 133 detects the slit.

In step S604, the processing performs a direct sensing operation, i.e., detects the amount of movement through image processing. Through image processing, the processing detects the distance over which the conveyance belt 205 has moved between imaging timing of the second image data in step S603 and that of the first image data in the previous step. The image processing will be described in detail below. The image of the conveyance belt 205 is captured the number of times predetermined based on the target conveyance amount at predetermined intervals.

In step S605, the processing determines whether the an image of conveyance belt 205 has been captured the predetermined number of times. When the image of the conveyance belt 205 has not been captured the predetermined number of times (NO in step S605), the processing returns to step S603 to repeat processing until the image capturing is completed. The processing is repeated the predetermined number of times while accumulating the conveyance amount each time the conveyance amount is detected, thus obtaining the conveyance amount for one band from the timing of first imaging in step S601. In step S606, the processing calculates a difference between the conveyance amount acquired by the direct sensor 134 and the conveyance amount acquired by the rotary encoder 133 for one band. Since the rotary encoder 133 indirectly detects the conveyance amount while the direct sensor 134 directly detects the conveyance amount, the detection precision of the former is lower than the latter. Therefore, the above-mentioned difference can be recognized as a detection error of the rotary encoder 133.

In step S607, the processing corrects medium conveyance control according to the detection error of the rotary encoder obtained in step S606. There are two different correction methods: a method for increasing or decreasing the current position information for medium conveyance control according to the detection error, and a method for increasing or decreasing the target conveyance amount according to the detection error. Either method can be employed. When the processing has accurately conveyed the medium 206 by the target conveyance amount through feedback control, the conveyance operation for one band is completed.

Figure 7:
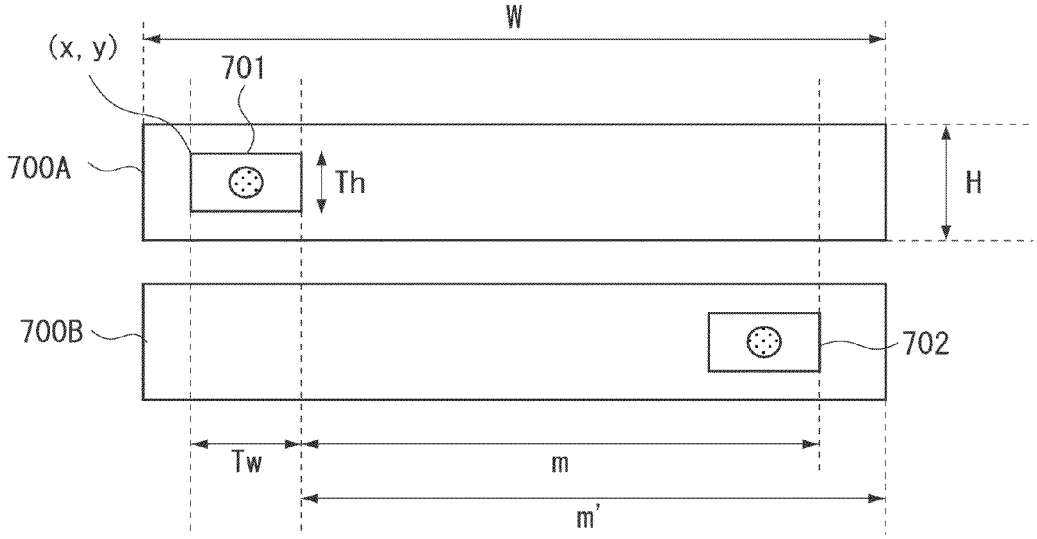
FIG. 7 illustrates a direct sensing operation.

FIG. 7 illustrates in detail the direct sensing operation in step S604. FIG. 7 schematically illustrates first image data 700A and second image data 700B of the conveyance belt 205 acquired in imaging by the direct sensor 134. The image sensor of the direct sensor 134 has a width W (pixel count) in the first direction (medium conveyance direction) and a width H (pixel count) in the second direction. During a time difference between acquisition timings of two different pieces of image data, the medium is conveyed by a conveyance amount m (pixel count). A conveyance amount m' is acquired based on a detection output of the rotary encoder 133. A template pattern used for pattern matching has a height Th (pixel count) and a width Tw (pixel count). The template pattern is extracted from a position having a coordinate (x, y). The width Tw is defined so that the following formula is satisfied.

$$Tw=W-m'-x$$

A circular pattern (○) (a portion having a luminance gradient) in the first image data 700A and the second image data 700B is an image of a marker inscribed on the conveyance belt 205. When the subject of sensing is a medium as is the case with the apparatus illustrated in FIG. 2, a microscopic pattern on the surface of the medium (for example, a paper fiber pattern) plays a similar role to the markers. The processing sets a template pattern 701 at an upstream position in the first image data 700A, and extracts an image of this portion. The setting method will be described in detail below. When the second image data 700B is acquired, the processing searches for a position (in the second image data 700B) of a pattern similar to the extracted template pattern 701. Search is made by using a technique of pattern matching. Any one of known similarity determination algorithms including sum of squared difference (SSD), sum of absolute difference (SAD), and normalized cross-correlation (NCC) can be employed. In this example, a most similar pattern is located in an area 702. The processing obtains a difference in the number of pixels of the image sensor in the sub scanning direction between the template pattern 701 in the first image data 700A and the area 702 in the second image data 700B. By multiplying the difference in the number of pixels by the distance corresponding to one pixel, the amount of movement (conveyance amount m) and further the moving speed can be obtained.

Figure 8:
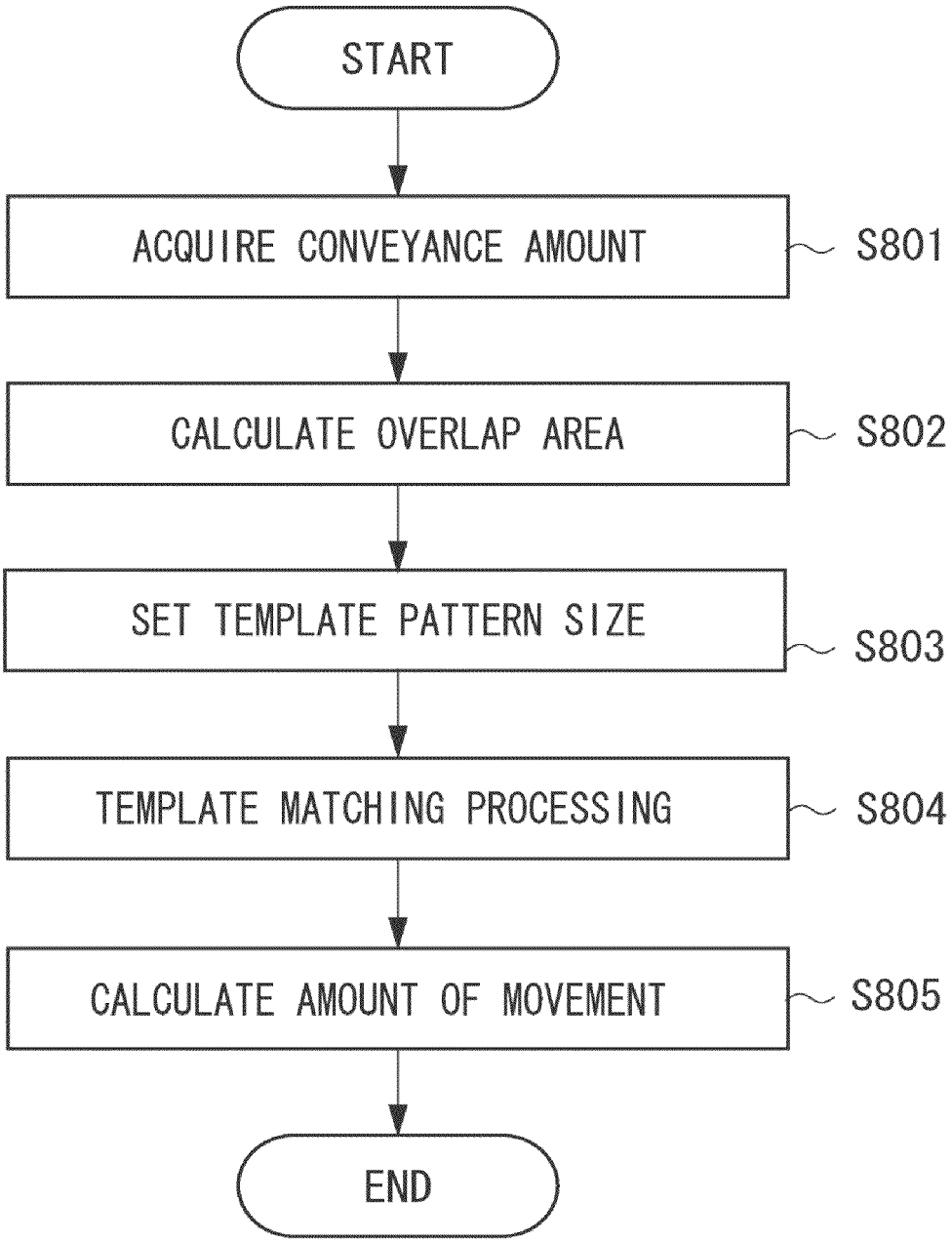
FIG. 8 is a flow chart illustrating a procedure for setting a template pattern.

FIG. 8 is a flow chart illustrating a procedure for setting a template pattern in direct sensing. This processing is performed by the processing unit of the controller 100.

In step S801, information about the moving state of an object between acquisitions of the first and second image data is indirectly or presumptively acquired. Specifically, the conveyance amount m' (conveyance amount m' illustrated in FIG. 7) of the medium by the conveyance mechanism is indirectly acquired during a time difference between acquisition timings of the two different pieces of image data, based on the detection output (pulse count value) of the rotary encoder 133 in that time. Although the detection precision of the rotary encoder 133, a unit configured to indirectly acquire the amount of movement, is lower than the detection precision of direct sensing through direct measurement of the surface of the object, a conveyance amount m' can be roughly estimated.

A unit for indirectly or presumptively acquiring a moving state is not limited to an rotary encoder. For example, the conveyance amount m' can be estimated from a control target value for servo control of the conveyance motor included in the conveyance mechanism or from a control pulse value for the conveyance motor (pulse motor). Alternatively, the present conveyance amount m can also be estimated from the conveyance amount acquired by the just preceding or a prior direct sensing operation. The conveyance amount is indirectly acquired on a presumption that the conveyance amount does not largely change during repetitive measurements. The conveyance amount by the just preceding or a prior direct sensing operation may be used as a presumption value. Alternatively, in consideration of the trend of increase and decrease in a plurality of predetected conveyance amounts, the just preceding conveyance amount may be corrected and the corrected amount may be used as a presumption value.

In step S802, the processing calculates W−m'. W−m' means the width of an overlap area over which the two pieces of image data overlap with each other in the first direction.

In step S803, the processing sets a template pattern size. The processing calculates the width Tw in the first direction by using formula 1.

$$Tw=W-m'-\alpha-x \qquad \text{Formula 1}$$

The processing calculates the height Th in the second direction by using formula 2.

$$Th=H-\beta-y \qquad \text{Formula 2}$$

The coordinate (x, y) denotes a position from which the template pattern is extracted. The values x and y take into consideration lens distortion occurring at ends of image data. Adjustment values α and β reflect a dimensional error and attachment error of each part of the conveyance mechanism as well as slip due to the frictional difference between the medium and the roller. These adjustment values may be predetermined as static values or dynamically set through calibration.

In step S804, the processing performs a pattern matching operation based on a template pattern having an appropriate size by using the above-mentioned method. In step S805, the processing calculates the movement amount m from the result of pattern matching in step S804 by using the above-mentioned method. The movement amount m calculated through the direct sensing has a very high precision.

The larger the template pattern size, the lower the probability of incorrect determination due to noise or uneven density in the image data. On the contrary, when a template pattern having a large size is set in the case where a movement amount or moving speed is large, the area corresponding to the template pattern may not fit into the image of the second image data. The above-mentioned formula 1 defines a template pattern size in consideration of this balance.

Figure 6:
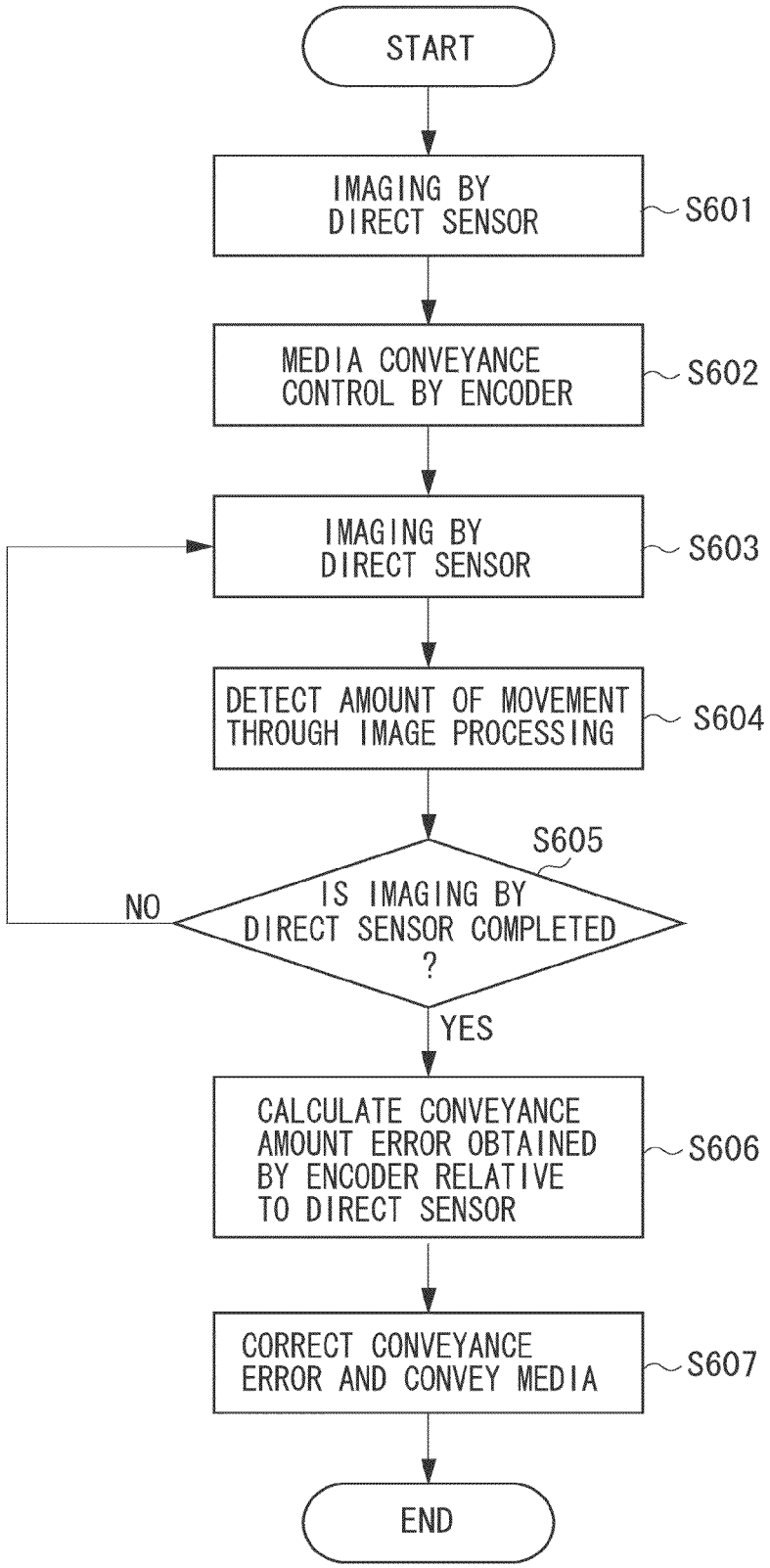
FIG. 6 is a flow chart illustrating processing of medium conveyance in a stepwise feeding manner.
Figure 9:
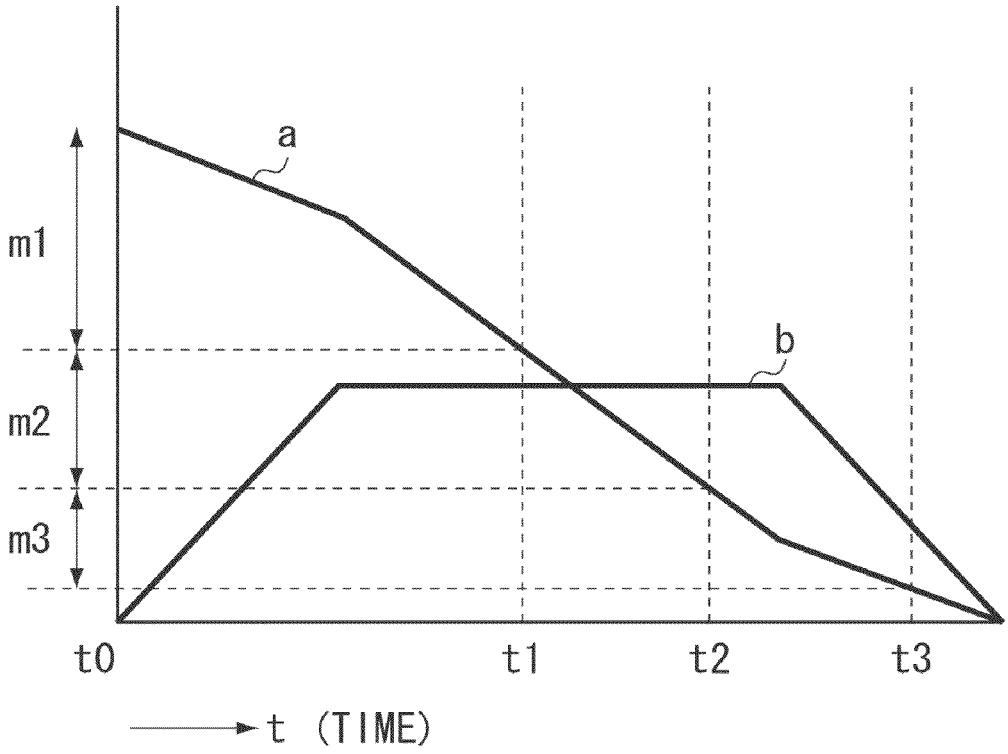
FIG. 9 is a graph illustrating an exemplary control profile.

FIG. 9 is a graph illustrating an exemplary control profile of medium conveyance control described in FIG. 6. Referring to FIG. 9, the horizontal axis denotes an elapsed time since medium conveyance control is started. A curve a denotes variation in the remaining conveyance amount up to a target position, and a curve b denotes variation in the medium conveyance speed. A time t0 denotes the timing of imaging in step S601. Times t1, t2, and t3 denote the timings of imaging in step S603. The time duration between the time t3 and the time when b=0 denotes the timing of correction processing in steps S606 and S607. The medium is conveyed by a conveyance amount m1 between the time t0 and the time t1, by a conveyance amount m2 between the time t1 and the time t2, and by a conveyance amount m3 between the time t2 and the time t3. As illustrated by the curve b, the medium is accelerated until a predetermined speed is reached and then the predetermined speed is maintained. When the medium approaches the target position, it is decelerated.

The conveyance amounts m1, m2, and m3 are indirectly acquired by using the detection value of the rotary encoder 133. Alternatively, the conveyance amounts m1, m2, and m3 are presumptively acquired from the control target value for servo control of the conveyance motor 171. Alternatively, the conveyance amounts m1, m2, and m3 are presumptively acquired from the control pulse value for the conveyance motor 171 (pulse motor). Alternatively, the conveyance amounts m1, m2, and m3 are presumptively acquired by using the detection value of a prior direct sensing operation.

Figures 10A, 10B, 10C, 10D:
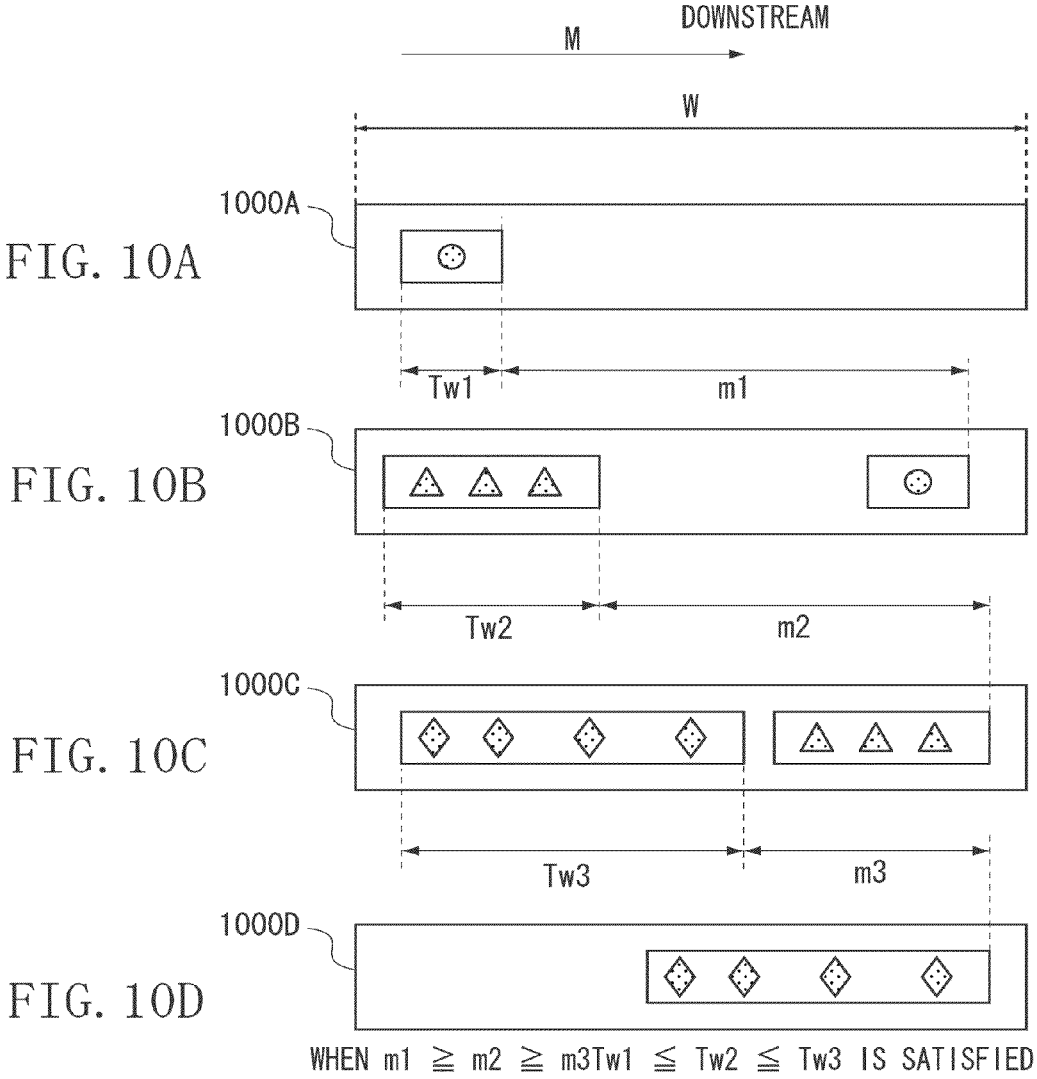
FIGS. 10A, 10B, 10C, and 10D schematically illustrate a plurality of pieces of image data acquired at different timings.

FIG. 10 schematically illustrates four different pieces of image data 1000A, 1000B, 1000C, and 1000D acquired at different times t0, t1, t3, and t4 by the image sensor. An arrow M denotes the conveyance direction (first direction) of the medium. A conveyance amount m1 between the image data 1000A and the image data 1000B corresponds to the conveyance amount m1 of FIG. 9. A conveyance amount m2 between the image data 1000B and the image data 1000C corresponds to the conveyance amount m2 of FIG. 9. A conveyance amount m3 between the image data 1000C and the image data 1000D corresponds to the conveyance amount m3 of FIG. 9.

In the processing described in step S802 of FIG. 8, the width of an overlap area between the image data 1000A and the image data 1000B is calculated as W−m1. Similarly, the width of an overlap area between the image data 1000B and the image data 1000C is calculated as W−m2, and the width of an overlap area between the image data 1000C and the image data 1000D is calculated as W−m3.

A template pattern having a width Tw1 in the first direction is extracted from the image data 1000A. Similarly, a template pattern having a width Tw2 is extracted from the image data 1000B, and a template pattern having a width Tw3 is extracted from the image data 1000C. In the case of m1>m2 (conveyance amount), the widths Tw1 and Tw2 are set so that Tw1<Tw2 is satisfied. Similarly, in the case of m2>m3, the widths Tw2 and Tw3 are set so that Tw2<Tw3 is satisfied. More specifically, the template pattern size in the first direction is dynamically and variably set according to the indirectly or presumptively acquired medium conveyance amount between acquisitions of the first and second image data. Specifically, when the conveyance amount is relatively large, a relatively small template pattern size is set; when the conveyance amount is relatively small, a relatively large template pattern size is set. More specifically, in the case of m1≧m2≧m3 (conveyance amount), the widths Tw1, Tw2, and Tw3 are set so that Tw1≦Tw2≦Tw3 is satisfied. Further, the widths Tw1, Tw2, and Tw3 are set to satisfy Tw1<W−m1, Tw2<W−m2, and Tw3<W−m3, respectively, so that each template pattern fits into the image of the second image data. In other words, the template pattern size in the first direction is set so that it may not exceed the size of the imaging area picked-up by the image sensor minus the amount of movement of the object acquired by the acquisition unit. The template pattern size in a predetermined direction may be variably set based not on the amount of movement but on the moving speed obtained from the amount of movement and the relevant time duration. Further, regardless of the template pattern size, the template patterns are set uniformly in the vicinity of the upstream end in the first direction of the first image data.

Template pattern sizes may be prestored in memory in association with a plurality of conveyance amounts m (m1, m2, m3, . . . ), and loaded in relation to each conveyance amount m. In this case, it is not necessary to assign different template pattern sizes Tw to different conveyance amounts m. At least two template pattern sizes Tw may be set according to whether or not the conveyance amount exceeds a set threshold value.

In the first exemplary embodiment, the pattern matching operation is performed based on the template pattern size in the first direction variably set according to the information about the moving state between acquisitions of the first and second image data indirectly or presumptively acquired by the acquisition unit. This method solves the problem described in Problem to be solved by the Invention, enabling a reliable pattern matching operation to achieve highly reliable direct sensing. As a result, a printer having high reliability and high conveyance precision is provided.

In a second exemplary embodiment, at least two template pattern sizes are prestored, and any one of them is variably selected depending on the situation. The second exemplary embodiment will be described below mainly with respect to differences from the first exemplary embodiment.

FIG. 11 is a table illustrating an association between the conveyance amount, the conveyance speed, and the template pattern size in medium conveyance control in step S502 of FIG. 5. Although only two examples of template pattern sizes are described, three or more template pattern sizes may be used. When the conveyance amount M1>M2 or the conveyance speed S1>S2, each numerical value is determined so that the template pattern size T1<T2 is satisfied. Numerical values calculated in advance are prestored in a data table in memory, and an associated template pattern size is loaded from memory and set according to the used conveyance mode (conveyance amount or conveyance speed).

Figure 12:
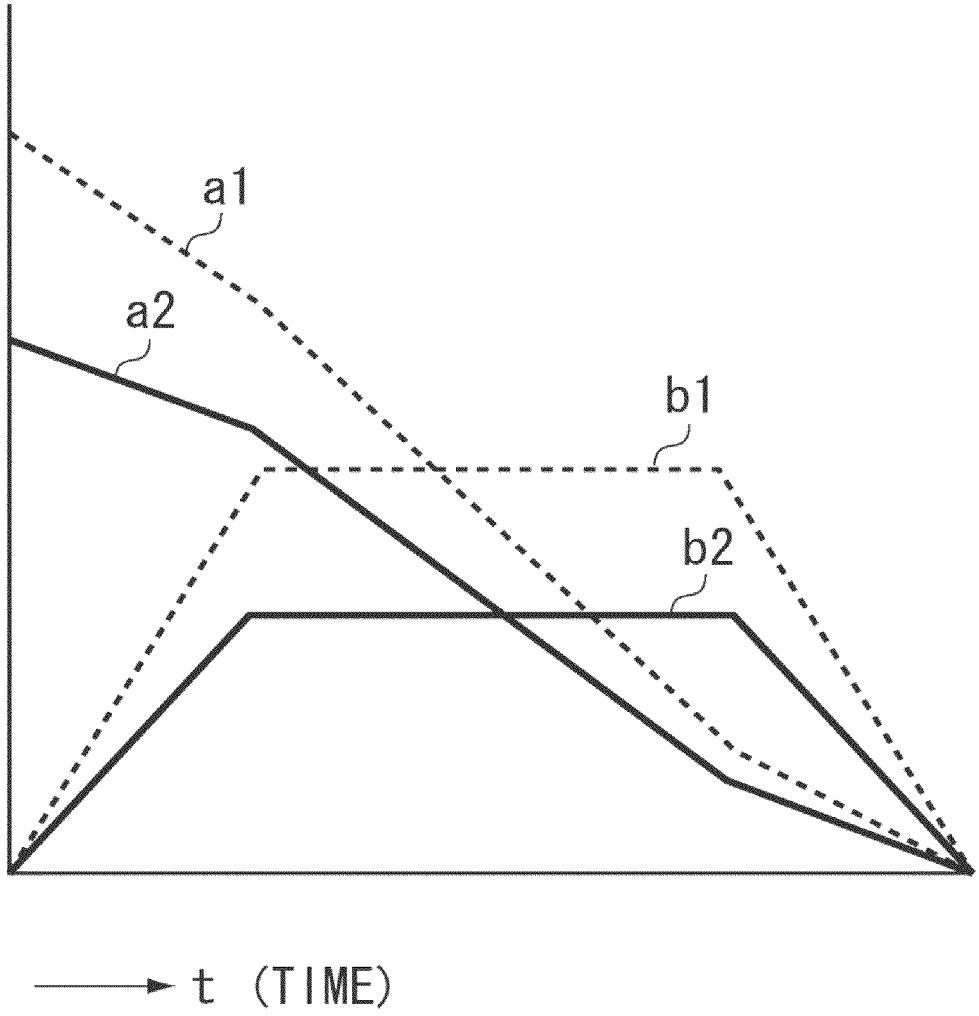
FIG. 12 is a graph illustrating an exemplary control profile.

FIG. 12 illustrates the medium conveyance control mode illustrated in FIG. 11. Referring to FIG. 12, the horizontal axis denotes an elapsed time since medium conveyance control is started. A curve a1 denotes variation in the remaining conveyance amount up to the target position for the conveyance amount M1. A curve b1 denotes variation in the conveyance speed corresponding to the curve a1. On the other hand, a curve a2 illustrates the remaining conveyance amount up to the target position for the conveyance amount M2. A curve b2 illustrates variation in the conveyance speed corresponding to the curve a2. The curves b1 and b2 have different maximum speeds (S1 and S2) during a certain time period after acceleration. The conveyance speeds (b1 and b2) are changed according to the two different conveyance amounts M1 and M2 so that one conveyance operation is completed at the same time in any conveyance mode.

Figure 13:
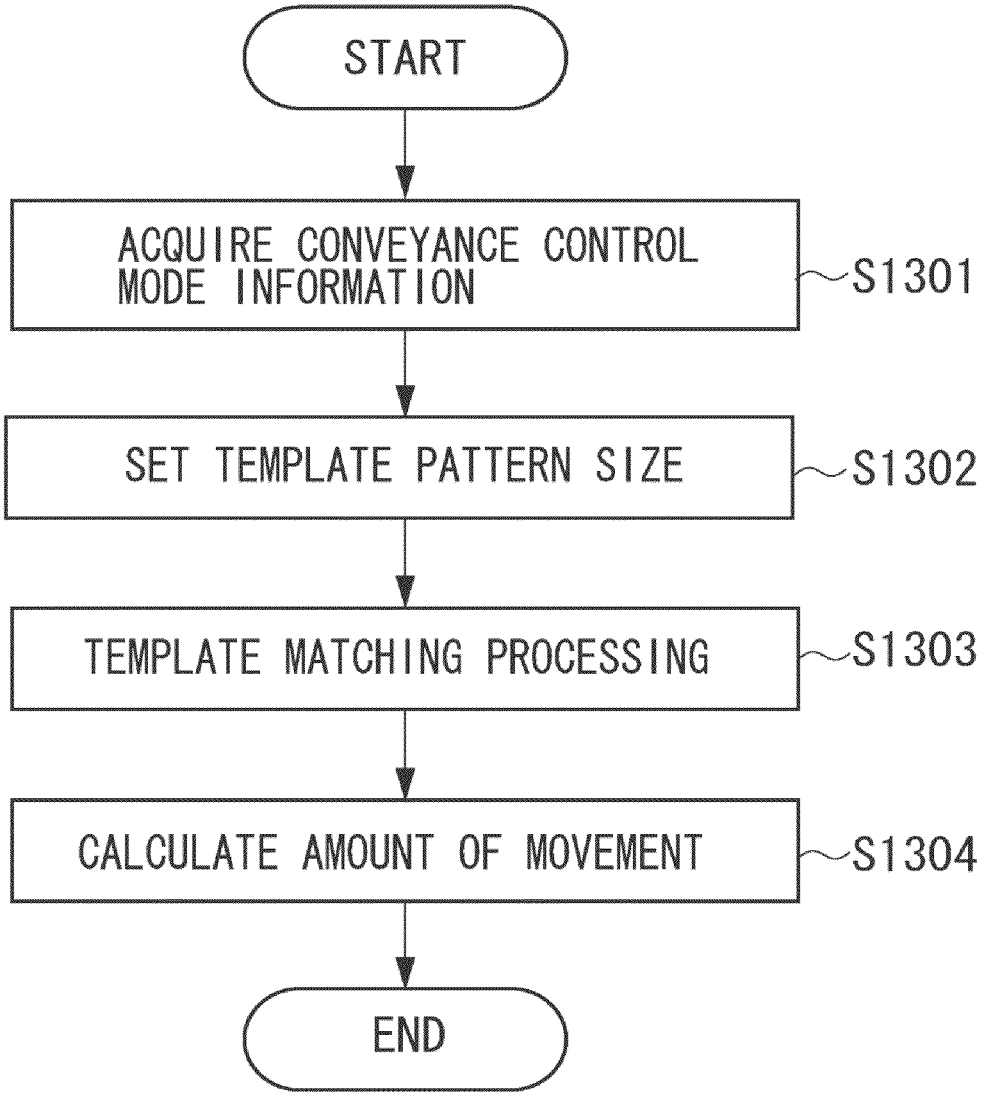
FIG. 13 is a flow chart illustrating a procedure for setting a template pattern.

FIG. 13 is a flow chart illustrating a procedure for setting a template pattern. This processing is performed in step S604 described in FIG. 6. In step 1301, the processing acquires the conveyance amount (M1 or M2) for the current medium conveyance control mode. In step S1302, the processing loads from memory a template pattern size associated with the acquired conveyance amount and then sets it. In step S1303, the processing performs the pattern matching operation based on the set template pattern by using the above-mentioned method. In step S1304, the processing calculates the amount of movement from the result of pattern matching in step S804 by using the above-mentioned method.

According to the second exemplary embodiment, the pattern matching operation is performed based on the template pattern size in the first direction variably set according to the information about the moving state between acquisitions of the first and second image data indirectly or presumptively acquired by the acquisition unit. Thus, similar effects to the first exemplary embodiment can be acquired.

The first and second exemplary embodiments are based on a presumption that direct sensing detects the movement in one direction (from the upstream side to the downstream side). A third exemplary embodiment, on the other hand, enables detecting the movement in both directions (from the upstream side to the downstream side, and vice versa).

Figure 14:
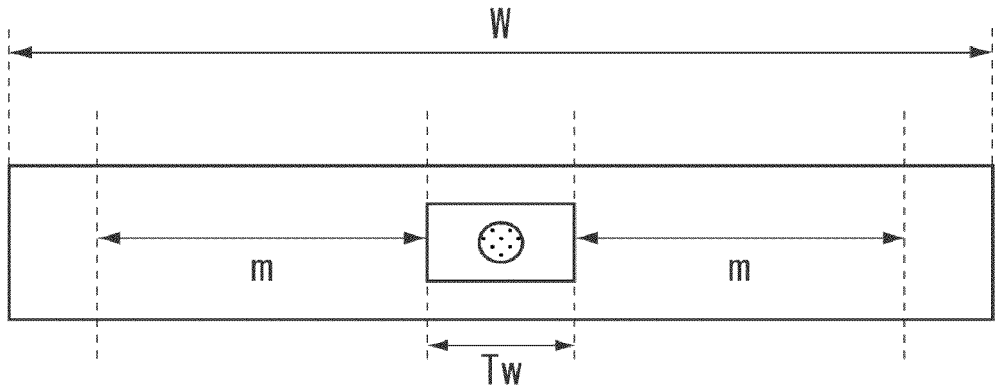
FIG. 14 illustrates an exemplary template pattern setting in the case of the bidirectional conveyance direction.

FIG. 14 illustrates an exemplary template pattern setting when the conveyance belt 205 is conveyed in both directions. The position of the template pattern is set at the center of the image data, and the conveyance amount m is set in both directions (on the upstream and downstream sides). Therefore, since a large pattern size Tw and a large conveyance amount m cannot be ensured, there may be failure in the pattern matching operation.

Figure 15A:
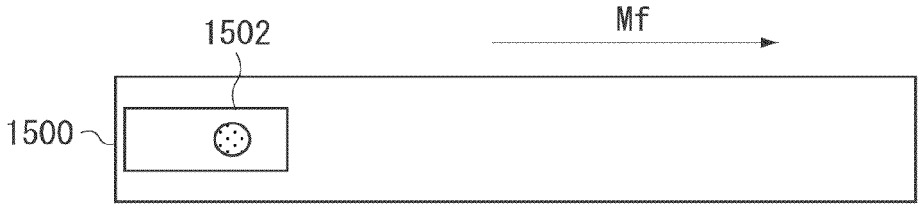
FIGS. 15A and 15B illustrate exemplary template pattern position settings according to the conveyance direction.
Figure 15B:
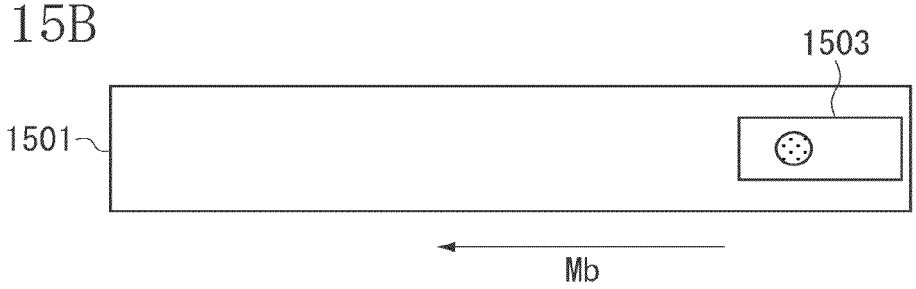

To solve this problem, in the third exemplary embodiment, a template pattern is set at an appropriate position according to the conveyance direction of the conveyance belt 205. FIGS. 15A and 15B illustrate exemplary template pattern position settings according to the conveyance direction. FIG. 15A illustrates the position of a template pattern 1502 set for first image data 1500 when the conveyance belt 205 moves in a direction Mf (from the upstream side to the downstream side). The template pattern 1502 is set in the vicinity of the upstream end of the first image data 1500. Since a room appears in the downstream side of movement, the template pattern 1502 having a large size can be ensured. FIG. 15B illustrates the position of a template pattern 1503 set for first image data 1501 when the conveyance belt 205 moves in a direction Mb (from the downstream side to the upstream side). The template pattern 1503 is set in the vicinity of the downstream end of the first image data 1501. Since a room appears in the upstream side of movement, the template pattern 1503 having a large size can be ensured.

Figure 16:
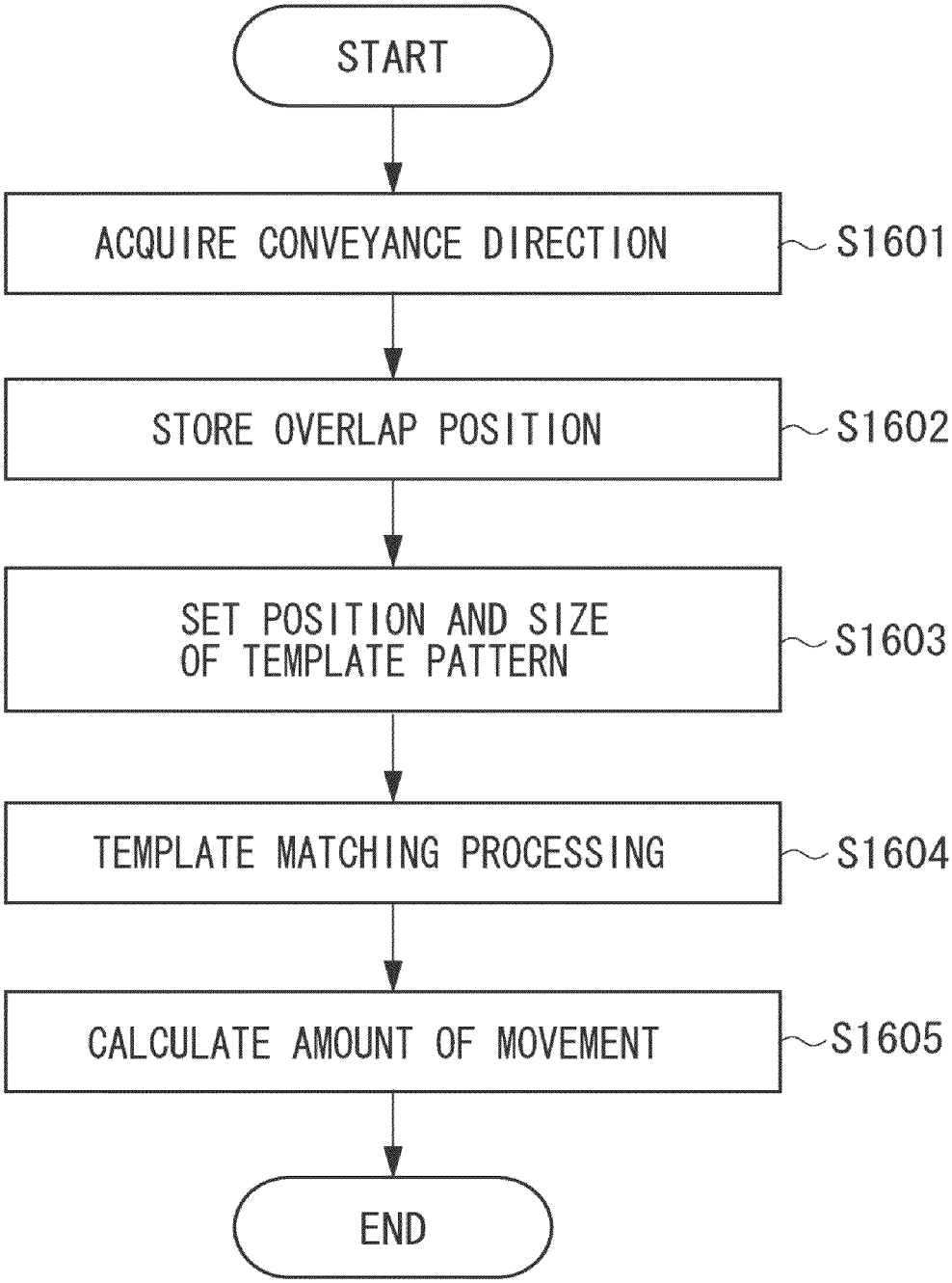
FIG. 16 is a flow chart illustrating a procedure for setting a template pattern.
Figure 17A:
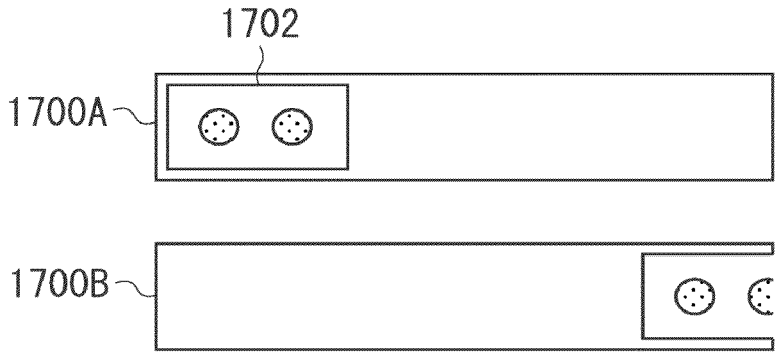
FIGS. 17A and 17B illustrate a problem in a pattern matching operation.
Figure 17B:
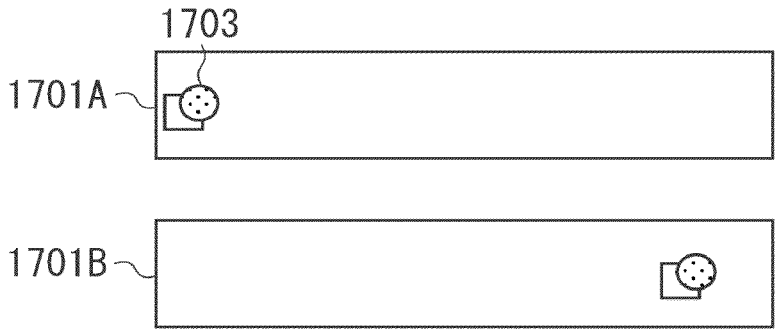

FIG. 16 is a flow chart illustrating a procedure for setting a template pattern. This processing is performed in step S604 described in FIG. 6. In step S1601, the processing acquires the conveyance direction of the conveyance belt 205. The conveyance direction can be detected from the rotational direction of the conveyance motor 171 to be controlled. In step S1602, the processing determines the side (right-hand side or left-hand side) on which the two pieces of image data overlap with each other from the acquired conveyance direction, and obtains the overlap position.

In step S1603, the processing obtains the positional coordinate and size of the template pattern. The overlap position and the positional coordinate (x, y) to be set for the template pattern are prestored in an associated way in a data table in memory. The processing reads from memory the positional coordinates (x, y) associated with the overlap position obtained in step S1602. Further, as described in the above-mentioned exemplary embodiments, the template pattern size is variably set. In step S1604, the processing performs the pattern matching operation based on the set template pattern by using the above-mentioned method. In step S1605, the processing calculates the amount of movement from the result of pattern matching in step S1604 by using the above-mentioned method.

According to the third exemplary embodiment, a template pattern is set at an appropriate position according to the moving direction of an object to be detected. As a result, the width size of the template pattern can be set to an appropriate value regardless of the moving direction.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-250825 filed Oct. 30, 2009, which is hereby incorporated by reference herein in its entirety.

What is claimed is:

1. An apparatus comprising:

a conveyance mechanism configured to move an object in a predetermined direction;

a sensor configured to capture an image of a surface of the object to acquire first and second data;

a processing unit configured to extract a template pattern from the first data, and seek an area having a correlation with the template pattern among areas in the second data to obtain a moving state of the object; and an acquisition unit configured to acquire information about the moving state between acquisitions of the first and second data, wherein the processing unit sets a template pattern size in the predetermined direction according to the acquired information.

2. The apparatus according to claim 1, wherein the acquisition unit acquires information about an amount of movement and moving speed of the object between acquisitions of the first and second data.

3. The apparatus according to claim 1, wherein the acquisition unit acquires the information from a detection value of an encoder configured to detect a rotating state of a roller included in the conveyance mechanism.

4. The apparatus according to claim 1, wherein the acquisition unit acquires a conveyance amount from a control target value for servo control of a motor included in the conveyance mechanism, or a control pulse value for a pulse motor included in the conveyance mechanism to acquire the information.

5. The apparatus according to claim 1, wherein the acquisition unit acquires a present moving state from the information about the moving state of the object acquired in a preceding or a prior direct sensing operation to acquire the information.

6. The apparatus according to claim 1, wherein the processing unit sets a template pattern size in the predetermined direction so that it may not exceed a size of an imaging area to be imaged minus an acquired amount of movement of the object.

7. The apparatus according to claim 1, wherein the conveyance mechanism move the object in both directions, and wherein the processing unit sets the template pattern in a vicinity of an upstream end of the first data when moving the object from an upstream side to a downstream side, and in the vicinity of a downstream end of the first data when moving the object from the downstream side to the upstream side.

8. The according to claim 1, wherein the processing unit sets a template patterns in a vicinity of the upstream end in the predetermined direction of the first data.

9. The apparatus according to claim 1, wherein the object is a recording medium or a conveyance belt configured to convey the medium thereon.

10. The apparatus according to claim 9, further comprising:

a control unit configured to control a drive of the conveyance mechanism based on the moving state of the conveyance belt or the recording medium.

11. A recording apparatus comprising:

the apparatus according to claim 1; and a recording unit configured to perform recording on the moving object.

12. A method comprising:

moving an object in a predetermined direction by a conveyance mechanism;

capturing an image of a surface of the object to acquire first and second data;

extracting a template pattern from the first data, and seeking an area having a correlation with the template pattern among areas in the second data to obtain a moving state of the object;

acquiring information about the moving state between acquisitions of the first and second data; and setting a template pattern size in the predetermined direction according to the acquired information.

13. The method according to claim 12, further comprising acquiring information about an amount of movement and moving speed of the object between acquisitions of the first and second data.

14. The method according to claim 12, further comprising acquiring the information from a detection value of an encoder configured to detect a rotating state of a roller included in the conveyance mechanism.

15. The method according to claim 12, further comprising presuming a conveyance amount from a control target value for servo control of a motor included in the conveyance mechanism, or a control pulse value for a pulse motor included in the conveyance mechanism to acquire the information.

16. The method according to claim 12, further comprising presuming a present moving state from the information about the moving state of the object acquired in a preceding or a prior direct sensing operation to acquire the information.

17. The method according to claim 12, further comprising wherein setting a template pattern size in the predetermined direction so that it may not exceed a size of an imaging area to be imaged minus an acquired amount of movement of the object.

18. The method according to claim 1, further comprising moving the object in both directions by the conveyance mechanism; and setting the template pattern in a vicinity of an upstream end of the first data when moving the object from an upstream side to a downstream side, and in the vicinity of a downstream end of the first data when moving the object from the downstream side to the upstream side.

19. The method to claim 12, further comprising setting a template patterns in a vicinity of the upstream end in the predetermined direction of the first data.

20. The method according to claim 12, wherein the object is a recording medium or a conveyance belt configured to convey the medium thereon.

* * * * *